United States Patent [19]

Shaw

[11] Patent Number: 4,928,667

[45] Date of Patent: May 29, 1990

[54] GAS FIRE HEATING UNIT

[75] Inventor: William S. Shaw, Prince George, Canada

[73] Assignee: Tri Fire Holdings, Ltd., Prince George, Canada

[21] Appl. No.: 406,016

[22] Filed: Sep. 12, 1989

[51] Int. Cl.[5] ..... F24B 7/00

[52] U.S. Cl. ..... 126/512; 126/502; 126/523; 126/533; 126/110 E; 237/50; 237/55; 237/11

[58] Field of Search ..... 126/512, 502, 504, 515, 126/516, 517, 522, 523, 528, 529, 531, 533, 110 A, 99 R, 99 D, 110 E, 116 A, 116 B, 112; 237/2 R, 2 A, 11, 50, 52, 53, 55

[56] References Cited

U.S. PATENT DOCUMENTS

| | | | |
|---|---|---|---|
| 2,270,940 | 1/1942 | Elmore | 126/512 |
| 2,671,440 | 3/1954 | Dupler | 126/512 |
| 3,659,646 | 5/1972 | Hurko et al. | 165/165 |
| 4,185,612 | 1/1980 | Briner et al. | 126/509 |
| 4,280,474 | 7/1971 | Ruegg, Sr. | 126/523 X |
| 4,426,994 | 1/1984 | Burger et al. | 126/531 X |
| 4,556,105 | 12/1985 | Boner | 165/165 |

*Primary Examiner*—Larry Jones

*Attorney, Agent, or Firm*—Lowe, Price, LeBlanc, Becker & Shur

[57] ABSTRACT

A gas fire space heater which can be an insert for an existing fireplace or a free standing unit is described. The device consists of a gas burner with radiants disposed within a housing. The products of combustion are collected in a first plenum, directed through a concertina heat exchanger into a second plenum, and from the second plenum up a flue. Air to be heated is collected by a blower and circulated countercurrently to the products of combustion through the heat exchanger, around the housing, and into the space to be heated. Air to be heated is supplied to the blower from an outside vent, and an inside vent. The outside vent is controlled by a one-way suction damper and the inside vent is controlled by a manual damper. The two vents form a T at the fan inlet and control of the manual damper then controls the amount outside and inside air supplied to the blower. A thermostatic control is provided in the flue to ensure that the blower is shut off if the flue temperature drops below a predetermined temperature whereby the flue may no longer draw. The preferred blower capacity is 200 cubic feet per minute, and the concertina heat exchanger is about three and one half inches by sixteen inches by sixteen inches.

10 Claims, 4 Drawing Sheets

GAS FIRE HEATING UNIT

This invention relates to a space heater designed primarily to heat the living area of a house, which may be retrofitted into an existing fireplace, or adapted to function as a free standing unit. The device of this invention is intended to be an extremely efficient means to supplement the conventional furnace used in a home.

The prior art contains many patents which are directed to space heating devices which may be either retrofitted into an existing fireplace, or constructed as a fireplace for circulating air around the fire box so that when wood or coal is burned in the fire box, the heat of combustion will be extracted and circulated in the room to more efficiently utilize the heat generated by the fire. As is well known, in conventional fireplaces, radiant energy from the combustion of fuel is the primary source of heat within the room, and a large amount of the heat generated is lost in the products of combustion as they exit the flue. A number of prior art devices have attempted to utilize the heat of combustion by circulating outside air, inside air, or a mixture around the fire box and flue so that the heat therein may be captured in the form of convection currents which exit the fireplace into the room.

The primary source of fuel in such prior art devices has been wood. It has been increasingly evident however that such prior art devices have substantial disadvantages. For example, the products of combustion exiting the flue have in some residential areas become a major source of pollution. In addition, wood is bulky to handle and in many areas of the country expensive to obtain. A similar problem is presented with the use of coal.

In addition, in fireplace inserts, many existing fireplaces do not have sufficient depth to permit retrofitting fireplace inserts without major construction. Because such inserts normally circulate air to be heated around the fire box, it is necessary that the fire box have at least a double wall and in some units a triple wall. Baffles, fins, and the like are also utilized to effect heat exchange. Such heat exchangers then can only be retrofitted in a very large fireplace because the fire box itself must remain sufficiently large to accommodate logs to be burned.

As described for example in U.S. Pat. No. 4,185,612, the rear wall of the fire box may be in the form of a convoluted surface to facilitate heat exchange with a mixture of outside and inside air as it circulates around the fire box. The convoluted surface functions similarly to a plurality of baffles forcing the air to be heated into a tortuous path through the inside of the back wall while the products of combustion and the radiant energy from the fire heat the fire box walls. As will be evident then the back wall of the fire box must have a substantial thickness in order to maximize heat exchange.

It has been discovered however that a space heating unit can be provided which can be retrofitted into virtually any fireplace because it utilizes an extremely small, compact, and efficient heat exchanger in combination with a gas fired burner to thereby eliminate the need for a fire box as such. The existing fireplace then continues to function as the fire box. In another embodiment of this invention, the device may be also adapted to a free standing unit which also is small, compact, and very efficient. The device of this invention then utilizes the radiant energy generated by the combustion of natural gas, and further extracts a desired amount of heat from the products of combustion to heat air which is then discharged into the living area to be heated as convention currents. The heat exchanger of this invention then extracts the desired amount of heat from the products of combustion before they exit the flue.

It has also been discovered that the amount of heat extracted from the products of combustion must be controlled. In many conventional fireplace inserts, condensation within the flue presents a problem. If too much heat is extracted from the products of combustion, there will be difficulty in maintaining the flow of products of combustion up the flue. In addition to condensation, if the products of combustion are too cool, the chimney or flue will not "draw" and the possibility of products of combustion entering the room to be heated will be presented. Such products of combustion can be both noxious and poisonous.

Finally, it is also highly desirable to control the amount of outside air admitted to the unit to be heated. The device of this invention with a damper disposed within the room to be cooled directly controls the amount of room air admitted to the device to be heated, and indirectly controls the amount of outside air also admitted. Therefore, if the outside ambient temperature is very cold, it may be desirable to use only a minimum amount of outside air to thereby decrease the amount of fuel required.

The device of this invention then utilizes a gas burner with conventional ceramic radiants to radiate heat from the fire, and a heat exchanger disposed above the burner in communication with the flue. The heat exchanger of this invention is a concertina type heat exchanger and it has been discovered that sufficient heat can be extracted from the products of combustion in a unit which is only sixteen inches by sixteen inches by three and one half inches high. Furthermore, it is also desirable to vent the products of combustion through a separate flue which is insulated to retain the heat left therein so that the temperature thereof will be between about 190° and 290° F. A separate blower is utilized to circulate the air to be heated through the heat exchanger and into the room. The blower is fed both by a damper controlled vent of room air, and outside air through a separate vent controlled by a one way suction valve.

In a preferred embodiment, the blower is controlled manually and controlled by a thermostat in the flue so that if the flue temperature reaches about 190° F. the blower will be turned off, and if the flue temperature reaches about 290° F. the blower will be turned on. In this way, both condensation and the possibility that products of combustion would enter the room are eliminated.

Accordingly, it is an object of this invention to provide a gas fired space heater which will rapidly and effeciently supplement and existing furnace.

It is also an object of this invention to provide a gas fired fireplace insert which is sufficiently small and compact to fit into virtually any existing fireplace.

It is further an object of this invention to provide a gas fired fireplace insert which uses a concertina heat exchanger to extract heat from the products of combustion and warm a combination of air from within the room to be heated and outside air as desired by the user.

It is further object of this invention to provide a gas fired fireplace insert with its own insulated flue which is thermostatically controlled to ensure that the temperature of the combustion gases is neither too cool nor too hot.

It is still further object of this invention to provide a gas fired fireplace insert which is sufficiently compact to fit in virtually any existing fireplace, and which has a damper control to control whether the air to be heated therein is air from within the room, outside air, or a combination. These and other objects will become readily apparent with reference to the drawings and following description wherein.

Figure 1:
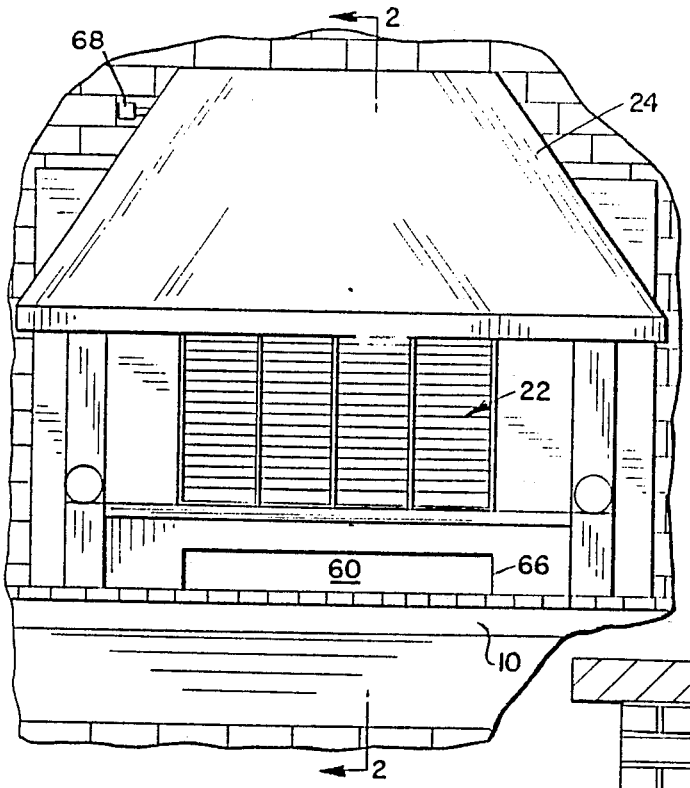
FIG. 1 is a fragmentary front view of the fireplace insert of this invention.

With attention to the drawings and to the embodiment of FIG. 1–4 in particular, a convention fireplace consists of a hearth 10, a fire brick back wall 12 and a fire box 14 which opens into a flue 16. In the device of this invention a stainless steel housing 18 mounts a conventional gas burner 20 and conventional ceramic radiants 22 are disposed in front of the burner. As gas is consumed in the burner, the radiants, as is well known, heat and give off radiant energy. A hood 24 is disposed over the burner 20 and radiants 22 to collect the products of combustion in a plenum chamber 26. Chamber 26 then opens into the heat exchanger 28 of this invention. As the products of combustion pass through the heat exchanger they are collected in an exit plenum 30 and then are discharged through flue 32 which extends up chimney 16.

Flue 32 is surrounded with preferably rock wool or similar insulation 34 at the bottom of flue 16 and flue 16 is then filled with a lightweight particulate insulation such as Zonolite or expanded shale 36. Chimney 16 then may be capped in the conventional fashion with a metal cap 38 and flue 32 would extend through a hole in cap 38 which is preferably sealed with conventional sealant 40. Flue 32 may also be capped with a conventional cap 42. Insulation insures that products of combustion will not be substantially cooled as they pass through flue 32.

Air is circulated through the device of this invention with a blower 44 which may be a squirrel cage type device. The blower is fed internal air through vent 46 in hood 24, the vent is controlled manually by a damper 48. Outside air enters through vent 50, through the fire wall 12, and the external wall 52 of the structure. A one way suction damper 54 controls the air admitted through vent 50. Internal vent 46 enters vent 50 at a T 56 immediately behind blower 44. The air to be heated then enters an inlet plenum chamber 58, circulates through heat exchanger 28, and circulates through chamber 60 around housing 18 and into the area to be heated. Heat exchanger 28 may be supported by legs 62 which rest on hearth 10.

The one way damper 54 includes a hinged flapper 62. When blower 44 is in operation, the amount of suction behind T 56 will be controlled by the internal damper 48. Therefore the more air admitted through vent 46, the less suction will be exerted on hinged flapper 62.

Preferably housing 18 is of stainless steel whereas hood 24 may be constructed of galvanized steel, 22 gauge, sprayed with a high heat mat black finish. The radiants 22 may be constructed of conventional high heat porcelain ceramic. As previously noted, the fan 44 preferably has a 200 cubic feet per minute capacity. Vent 50 may have a diameter of 6 inches whereas flue 32 may have a diameter of 4 inches. A conventional thermostat 64 may be disposed within the fireplace 14 adjacent flue 32 to control fan 44. Preferably, if thermostat 64 registers a temperature of about 190° F. or below the fan 44 should be shut off so that the internal temperature within the flue can rise. In contrast, if the fan is off and the temperature within the flue reaches about 290° F. the fan should be turned on to bring the temperature down.

Figure 2:
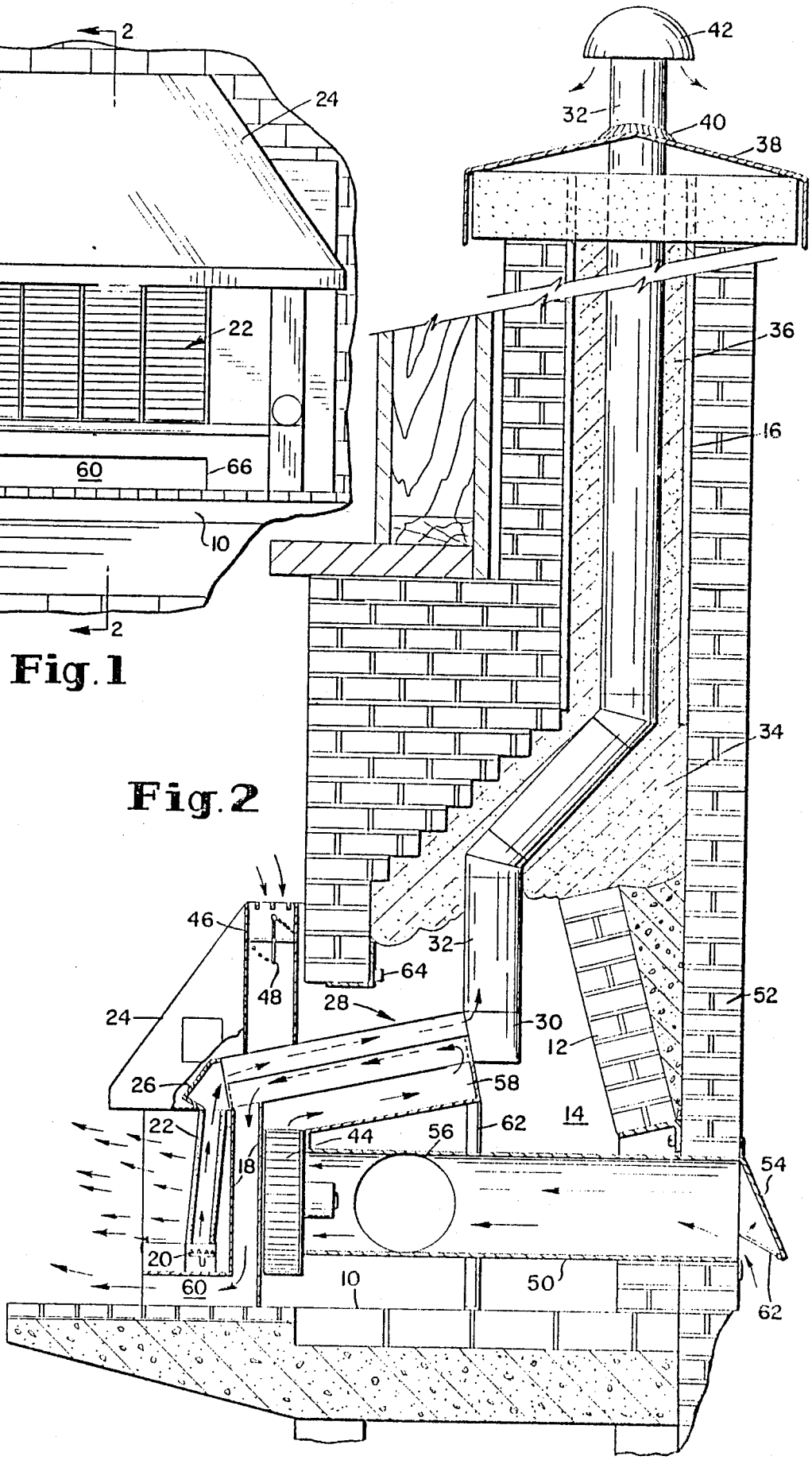
FIG. 2 is a cross-sectional view taken along lines 2—2 of FIG. 1 and including a cross-section of the flue.

With attention to FIG. 1, chamber 60 opens into an outlet 66 which directs heated air outwardly into the room as shown in FIG. 2 along the floor. The heat then will rise and circulate convection currents in the conventional fashion. The hood 64 also mounts an external switch 68 which controls damper 48. The controls for burner 20 are conventional and are not shown.

Figure 3:
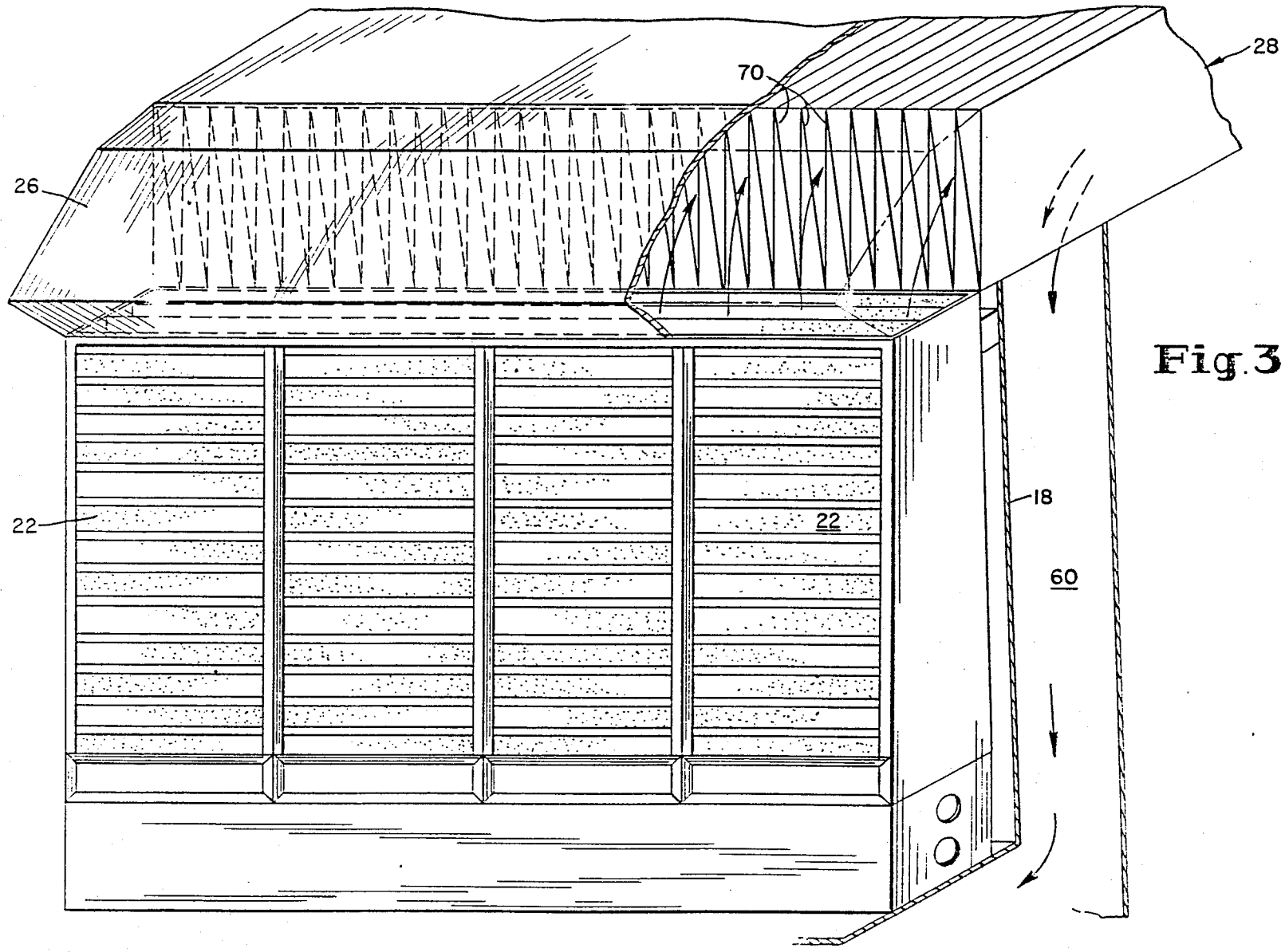
FIG. 3 is a fragmentary perspective view of the device of FIG. 1 with a portion of the front panel removed to expose the heat exchanger.

With attention to FIG. 3, the heat exchanger 28 of this invention is preferably sixteen inches long, sixteen inches deep and about three and one half inches high. It is a concertina type heat exchanger constructed by folding a sheet of 26 gauge stainless steel to form triangular passageways 70. The base of each triangle is about one half inch thick. The air to be heated then passes countercurrently with the combustion gases as they pass from plenum chamber 26 to the collection chamber 30. Collection chamber 30 then is about sixteen inches long and four inches deep.

Figure 4:
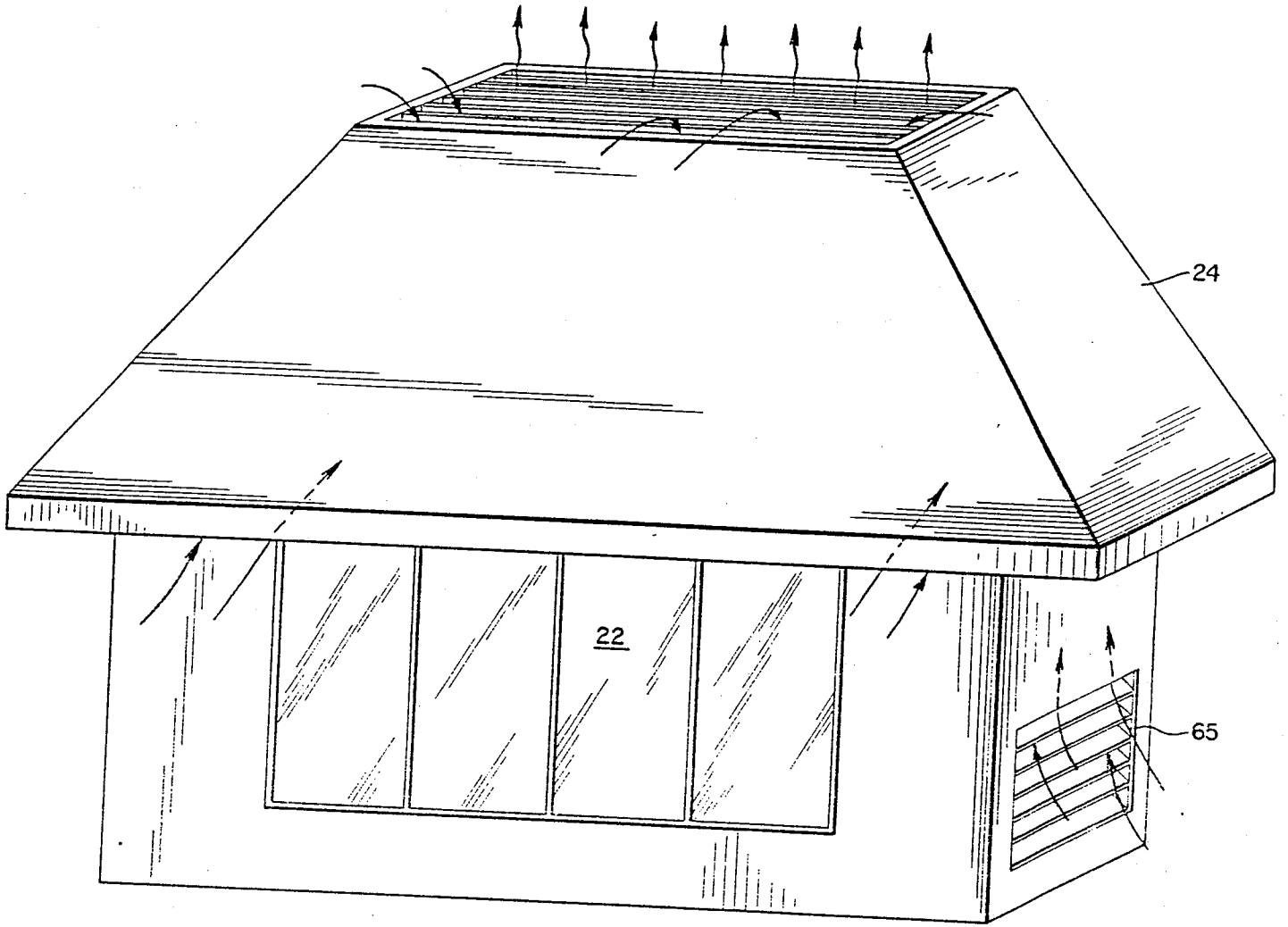
FIG. 4 is a view similar to FIG. 1 illustrating air circulation.

With attention to FIG. 4, it is also desirable to provide a free flow of air around the unit. Room air can be admitted also around hood 24 or at an inlet 65 provided on the side and returned to the room at the top of the unit. This free flow tends to keep the unit from overheating and can provide a flow of heated air even if the fan 44 is inoperable as for example during a power outage.

Figure 5:
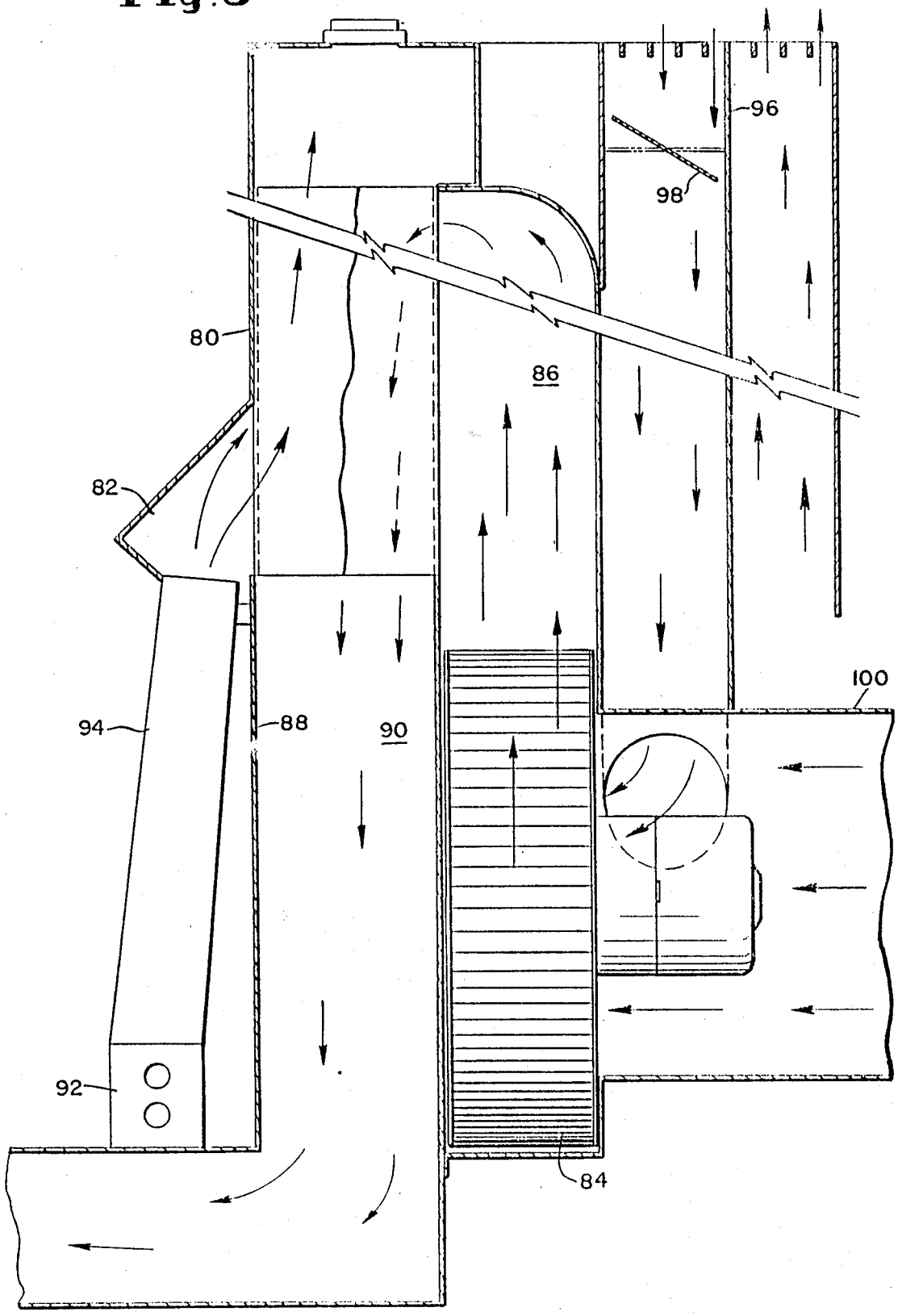
FIG. 5 is a fragmentary cross-sectional view of an alternate embodiment of this invention as a free standing unit.

With attention to FIG. 5, a free standing unit would be very similar to the embodiment of FIGS. 1–4 except that the heat exchanger 80 is disposed vertically. The products of combustion then would be collected in plenum chamber 82 and travel upwardly through heat exchanger 80 whereas the air to be heated from fan 84 would travel upwardly through chamber 86 and then downwardly through exchanger 80. The air would then be collected behind housing 88 in chamber 90 and ultimately exit into the room to be heated from chamber 90. The gas burner (not shown) would be contained within housing 92 and ceramic radiants 94 would be disposed thereover. The internal air vent 96 controlled by damper 98 could be disposed behind the unit and the outside air vent 100 could be disposed in the same fashion as the embodiment of FIGS. 1–4.

In summary, it has been discovered that by using a concertina type heat exchanger disposed between the gas burner and flue, efficient heating of air to be directed into convection currents within the room can be achieved in a heat exchanger which is only sixteen inches by sixteen inches by three and one half inches. Therefore the overall insert can be quite small and compact. In addition, it has been discovered that a 200 cubic foot per minute blower is quite suitable for directing the air to be heated through the heat exchanger and into the room to be heated. This fan by using an outlet damper which is a one way suction valve in an inlet vent which is manually controlled, can supply the desired mixture of internal air and external air to be heated. The fan however should preferably be controlled by a thermostat in the flue so that the temperature within the flue does not drop to the point that the flue will no longer draw and products of combustion will enter the room. The gas fired insert device of this invention then is sufficiently small to fit in virtually any fireplace as an insert, or can be a similarly small and compact free standing unit.

What is claimed:

1. A space heater for a structure adapted to be mounted in the fire box of a fireplace or as a free standing unit comprising:

a housing having a base, side walls and a rear wall;

a gas burner mounted in said housing on the base;

and a plurality of ceramic radiants covering the front of said housing and forming a front wall thereof so that when gas is consumed at said burner the radiants will be heated;

a hood mounted over said housing and defining a collection plenum means for collecting the hot products of combustion when gas is consumed in said housing;

a flue and a flue plenum in communication therewith;

a concertina heat exchanger having a plurality of inlets in communication with said collection plenum and a plurality of outlets at an opposite end thereof in communication with said flue plenum, said heat exchanger further defining a plurality of inlets for air to be heated adjacent the outlets and a plurality of outlets for heated air adjacent the inlets, said heat exchanger further includes a plurality of first and second passages for combustion products and air to be heated, respectively, wherein the first and second passages are in heat exchange relationship with one another;

blower means in communication with the heat exchanger inlets for supplying air to be heated thereto and circulating duct means in communication with the heated air outlets for directing said heated air into the space to be heated;

insulating means surrounding said flue, and thermostatic control means coupled to said blower means for terminating the air supplied by said means to the heat exchanger when the temperature in said flue falls below a predetermined limit.

2. The heater of claim 1 further comprising vent means in communication with said blower means for supplying air from outside the structure and for recirculating inside air in predetermined proportions.

3. The heater of claim 2 wherein said vent means includes a first duct in communication with said blower means and having an inlet for outside air and a one way suction damper means mounted in the inlet for controlling the flow of outside air therethrough, and an outlet in communication with said blower means.

4. The heater of claim 3 wherein said vent means further comprises a second duct in communication with said first duct through an outlet therein disposed adjacent the first duct outlet and an inlet opening into the space to be heated; and a damper means mounted in said inlet for controlling the flow of inside air therethrough.

5. The heater of claim 4 wherein said blower means comprises a fan having a capacity of about 200 cubic feet per minute.

6. The heater of claim 5 wherein the predetermined limit for said control means is about 190° F.

7. The heater of claim 1 wherein said heat exchanger further comprises a plurality of mutually spaced first passages therethrough provided for products of combustion and in communication between said plenums, and a plurality of second passages therethrough provided for air to be heated, said first and second passages being disposed between each other in heat exchange relationship with adjacent passages having common walls.

8. The heater of claim 1 wherein said blower means further comprises means for directing air to be heated through said second passages countercurrently to the flow of products of combustion from the collection plenum to the flue plenum.

9. The heat exchanger of claim 8 wherein each of said passages is triangular in cross-section and the side walls are common walls shared by adjacent passages.

10. The heat exchanger of claim 9 wherein the base of each triangle is about one half inch long and each triangle is about three and one half inches high.

* * * * *